US005237613A

United States Patent [19]

Berry et al.

[11] Patent Number: 5,237,613

[45] Date of Patent: Aug. 17, 1993

[54] POWDER ACTUATED TOOL AND METHOD FOR FORCING LOCKS

[76] Inventors: Brian E. Berry, 4115 Otterbein Ave., Indianapolis, Ind. 46227; Leo V. Peterson, 14124 Inwoods Cir., Bloomfield Hills, Mich. 48302

[21] Appl. No.: 903,144

[22] Filed: Jun. 24, 1992

[51] Int. Cl.[5] ..... F01B 29/08

[52] U.S. Cl. ..... 60/632; 60/635; 29/254

[58] Field of Search ..... 29/254; 60/632, 636, 60/635

[56] References Cited

U.S. PATENT DOCUMENTS 4,099,581 7/1978 Maret et al. ..... 60/636 X 5,119,634 6/1992 Berry et al. ..... 60/632

*Primary Examiner*—Stephen F. Husar

*Attorney, Agent, or Firm*—William W. Jones

[57] ABSTRACT

The powder actuated door lock-forcing tool has a modular construction which comprises: a pistol grip module; and a barrel assembly module. The barrel assembly module is readily detachable from the pistol grip module to allow interchangeability of different barrel assemblies which are specifically adapted to disrupt different types of door locks. The barrel assembly module includes a piston carried in a barrel, which piston is configured to be driven beyond the muzzleward end of the tool sufficiently to disable or disrupt a lock at which the tool is fired. The piston may have a cylindrical configuration or a flattened oval configuration at its muzzleward end.

10 Claims, 4 Drawing Sheets

POWDER ACTUATED TOOL AND METHOD FOR FORCING LOCKS

TECHNICAL FIELD

This invention relates to an improved piston-type powder-actuated tool. More particularly, this invention relates to a tool of the character described having an improved piston structure which is adapted to neutralize door locks when the piston is driven into a door or lock by firing the tool. Certain aspects of the preferred embodiment of the tool of this invention are disclosed and claimed in copending U.S. patent application No. 687,069, filed Apr. 18, 1991, now U.S. Pat. No. 5,119,634.

BACKGROUND ART

Law enforcement personnel, firemen, rescue personnel, and others frequently must force open locked doors in order to gain entrance to premises so that they can perform their duties therein. There are a number of different procedures for breaking through such locked doors, ranging from firing bullets into the locks; to axes for breaking the doors down; to lock picks for picking the locks; to crow bars; and so on. There are various drawbacks to such procedures, as for example, fired bullets can strike people inside or outside of the premises; an axe is difficult to use, time consuming, and can cause personal injury; crowbars are time consuming and sometimes ineffective; and lock picking requires special training, skills and knowledge.

It would be very desirable from a safety standpoint, and from an efficiency standpoint, to have a specialized tool which could be used to quickly neutralize a variety of door locks, wherein the force used to neutralize the locks is a captive force; and wherein no special skill is required to use the tool. A specialized powder-actuated tool would be very amenable to the aforesaid use.

Powder actuated tools are well known in the construction field for driving fasteners, such as nails, studs, or anchors, into a relatively hard supporting surface, such as concrete. Such tools utilize a piston for driving the fastener. The piston is typically driven by an explosive blank cartridge. Combustion gases generated from the cartridge drive the piston from a breechward position to a muzzleward position to drive the fastener into the supporting surface.

The explosive charge will occasionally overdrive the fastener driving piston, a condition which occurs when the piston is driven past the piston return pawl and into the buffer. This always occurs when the operator forgets to insert a fastener into the muzzle of the tool, and can also occur occasionally at other times. Such an occurrance is undesirable in a fastener driving tool.

DISCLOSURE OF THE INVENTION

According to this invention, a powder actuated tool is provided which has a specialized piston/barrel module that is adapted for use in breaking door bolts, or dislodging door lock cylinders from locked doors. The piston/barrel module is readily detachable from a pistol grip module so that the tool can be used with several different piston/barrel modules. There are a plurality of different piston/barrel module configurations, each of which is particularly adapted for use on a different type of door lock.

The piston/barrel module includes a barrel which has a breechward end with an integral firing chamber formed therein. The muzzleward end of the barrel is threaded to receive a muzzle bushing/piston guide for controlling movement of the piston toward the lock. The piston is disposed in a bore in the barrel, which bore communicates with the firing chamber to receive combustion gases from cartridges fired therein. A releasable locking pawl is mounted in a muzzleward end of the pistol grip module, the pawl extending into an elongated recess in the barrel to engage the piston/barrel module and releasably hold the latter in the pistol grip module. The barrel is closed except for a set of gas vent ports which moderate recoil when the tool is used. The gas vent ports are spaced muzzlewardly along the barrel so as to ensure that combustion gases will leave the barrel breechwardly of the piston head only after the piston has moved muzzlewardly past the vent ports. This ensures that the combustion gases cannot escape from the tool barrel bore until the piston has generated the necessary amount of energy needed to perform its lock neutralizing function.

One embodiment of the piston/barrel module used in the tool of this invention is particularly suitable for shooting the lock cylinders out of a door, or out of a door knob. In the lock cylinder destruction embodiment of the tool, the piston, barrel and muzzle bushing are similar in appearance to a conventional fastener driving tool, except that the barrel and piston are both longer than a conventional tool, and the piston is heavier. In addition, as in all of the tools of this invention, piston overdrive is intentional. The piston of this tool will be driven 2.5 inches to 3 inches beyond the muzzle end of the tool when the tool is fired. This ensures that the piston will penetrate the lock cylinder sufficiently to destroy the lock cylinder, and/or to dislodge it from a door or door knob.

A second embodiment of the piston/barrel module used in the tool of this invention is particularly suitable for use to breaking lock bolts or in driving lock bolts, such as dead bolts out of a door and door frame, when the tool is fired at the door or door frame. The bolt-breaking tool has a longer barrel assembly than a conventional fastener driving tool, and has a piston with a conventional breechward cylindrical piston head and piston stem, to which is affixed a muzzleward chisel blade and stem. The chisel blade has a flattened configuration with a sharpened or pointed muzzleward end. The chisel stem is rectangular in cross-sectional configuration. This embodiment of the tool has a muzzle guide member mounted on the muzzleward end of the barrel. The guide member has a flattened configuration (similar to a crevice tool accessory for a vacuum cleaner), and it guides movement of the chisel blade and chisel stem when the tool is fired. When the tool is fired, the chisel blade and stem will be driven about 3 inches past the muzzleward end of the guide so as to drive the chisel blade well into, and/or through a door or door jamb. A fraction of the chisel stem will remain in the guide after the tool is fired so as to maintain the proper orientation of the chisel blade relative to the guide.

Still another embodiment of the tool of this invention is particularly adapted to break padlocks. The padlock embodiment of the tool is provided with a shield mounted on the muzzleward end of the piston guide, which shield catches the several parts of the padlock after the tool is fired on the lock. This prevents parts of the broken lock from striking the person using the tool, and others near the person using the tool.

It is therefore an object of the invention to provide a powder actuated tool which is particularly adapted for forcing locks in doors, or the like, and which is composed of separate and individually replaceable modules.

It is a further object of the invention to provide a tool of the character described which is simple, and can be used on a variety of different lock types due to the modular construction thereof.

It is an additional object of this invention to provide a tool of the character described in which piston overdrive is intentionally effected.

These and other objects and advantages of the invention will become more readily apparent from the following detailed description of several preferred embodiments of a tool formed in accordance with this invention when taken in conjunction with the accompanying drawings in which:

DETAILED DESCRIPTION OF THE BEST MODE

Figure 1:
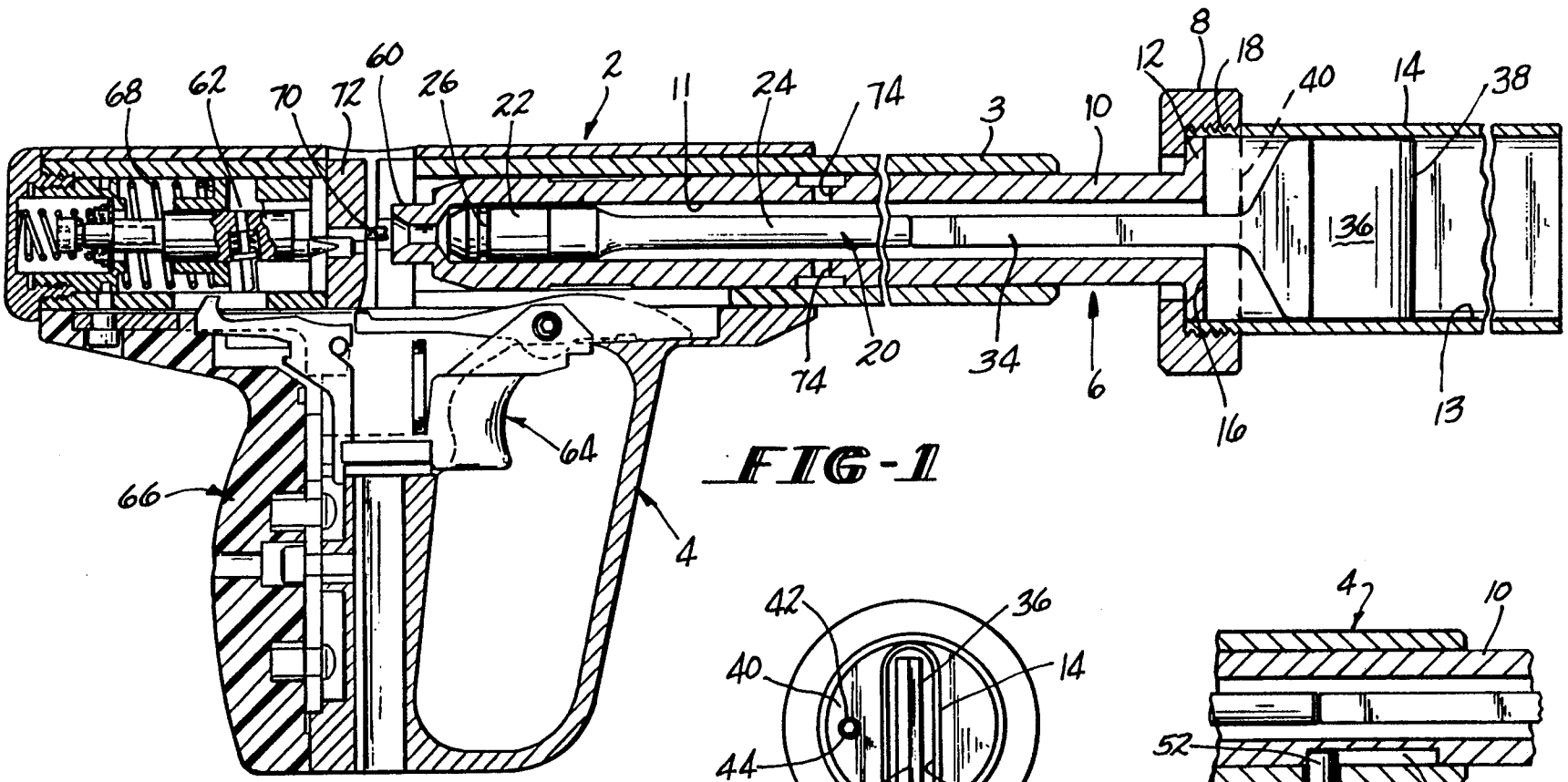
FIG. 1 is a side sectional view of one embodiment of the tool of this invention.

Referring now to FIG. 1, one embodiment of the powder actuated tool of the invention is shown, the tool being shown is a ready-to-fire state. The powder actuated tool 2 comprises a pistol grip module 4, and a piston/barrel module 6. The tool 2 is designed to utilize a strip of explosive charges which are automatically fed through the tool after each time the tool is fired and reset.

The piston/barrel module 6 includes a cylindrical barrel member 10, a piston/chisel member 20 disposed within the barrel 10, and a muzzle bushing/guide member 14 which is secured to the muzzleward end of the barrel 10 by a threaded collar 8 which is screwed onto an external thread 18 on the guide 14. The barrel 10 is formed with a muzzleward flange 12 against which the end surface 16 of the guide 14 is pressed. The collar 8 serves to hold the guide surface 16 against the barrel flange 12. The barrel 10 is mounted slideably within the muzzleward end 3 of the pistol grip module 4. The piston/chisel member 20 has a cylindrical piston head portion 22 and a cylindrical piston stem portion 24 extending along the bore 11 of the barrel 10 toward the guide 14. A piston ring 26 is disposed about the head portion 22 to provide a gas tight fit within the barrel bore 11. The piston/chisel member 20 also has a chisel stem portion 24 disposed in the barrel bore 11, and a chisel blade portion 36 with a sharpened end 38, the blade 36 being positioned in the interior 13 of the guide 14. The piston and chisel portions of the member 20 are preferably welded together, end-to-end.

Figure 2:
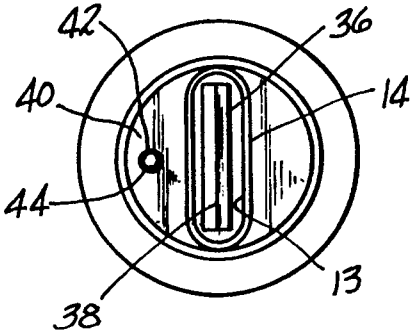
FIG. 2 is an elevational view of the muzzleward end of the tool.

As seen in FIG. 2, the configuration of the guide interior 13 closely conforms to the cross-sectional shape of the chisel blade 36. The basal part 40 of the guide 14 on which the threads 18 are formed is provided with a tapped through passage 42 in which a set screw 44 is disposed. The set screw 44 projects beyond the end surface 16 of the guide 14 into an opening (not shown) in the barrel flange 12. The set screw 44 and the flange opening serve to ensure that the guide interior 13, and thus the chisel blade 36 are properly oriented for the bolt-breaking operation to be performed by the tool.

Figure 3:
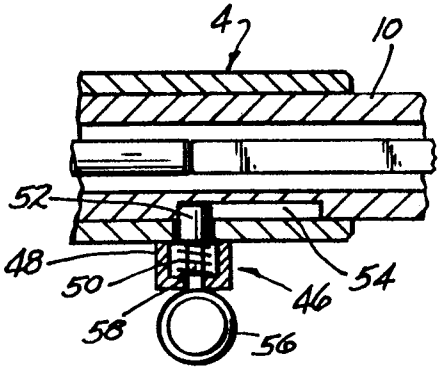
FIG. 3 is a fragmented view of the pistol grip module-piston/barrel module locking pawl.

As seen in FIG. 3, the detent pawl assembly 46 comprises a pawl housing 48, a spring 50 disposed within a bore in the housing 48, and a pawl 52 which is disposed in the pawl housing bore atop the spring 50. The pawl 52 extends into a barrel slot 54 to releasably connect the barrel 10 to the pistol grip module 4. A pull ring 56 is mounted on a stem 58 secured to the pawl 52. To release the barrel 10 from the grip module 4, the ring 56 is pulled to compress the spring 50 and withdraw the pawl 52 from the slot 54. The piston/barrel module 6 can then be pulled out of the pistol grip module 4.

Referring back to FIG. 1, the barrel 10 includes a breechward boss 60 which contains the cartridge firing chamber. A firing pin assembly 62 is slidably mounted in the tool breech, and a trigger 64 is mounted in the pistol grip 66 to actuate the firing pin assembly 62. A breech spring 68 biases the piston/barrel module 6 muzzlewardly by means of a biased push rod 70 which projects through the breech block 72 and engages the breechward end of the barrel 10.

Radial combustion gas vents 74 are disposed in the barrel 10 and are operable to vent combustion gases from the barrel bore 11 after the piston head 22 has passed the vents 74 during its work stroke. The vents 74 minimize tool recoil, while providing the piston/chisel member 20 to generate sufficient energy to perform its bolt or lock-breaking function. It will be noted that the barrel bore 11 is closed except for the vents 74, thereby providing the piston/chisel member 20 with the necessary lock-breaking energy.

Figure 4:
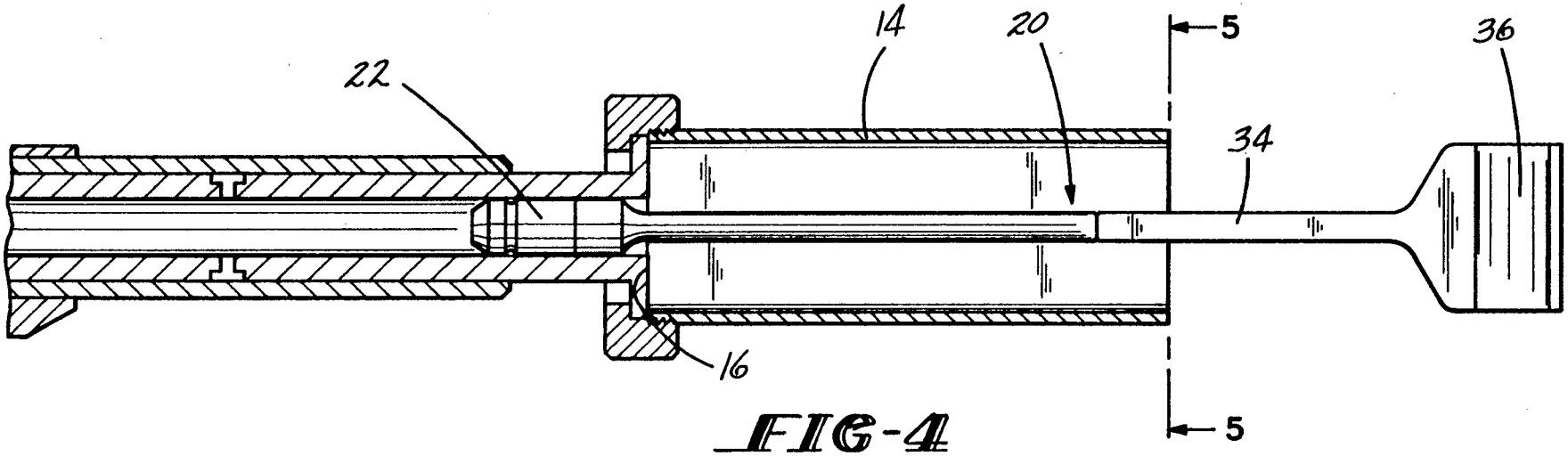
FIG. 4 is a fragmented sectional view of the muzzleward end of the tool of FIG. 1 showing the piston/chisel in its driven position.
Figure 6:
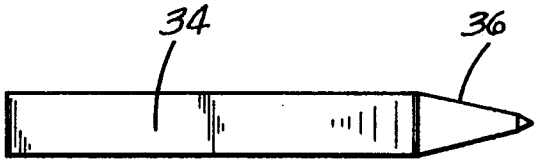
FIG. 6 is a side elevational view of the chisel portion of the piston/chisel component of the tool of FIG. 1.
Figure 5:
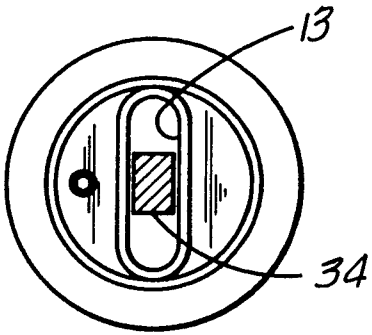
FIG. 5 is an elevational view of the muzzle end of the tool taken along line 5—5 of FIG. 4.

Referring to FIGS. 4–6, in FIG. 4, the piston/chisel member 20 is shown in its fired overdrive position wherein the chisel 36 extends well beyond the open end of the guide 14. In this position, the chisel 36 will have penetrated a door jamb into which the tool is fired, and will have cut or dislodged the door bolt or door lock from their door-locking positions. The surface 16 of the guide 14 acts as a stop surface for the piston head 22 to ensure that the lock-breaking force-producing member 20 remains captive in the tool.

The rectangular cross sectional shape of the chisel stem 34 and chisel blade 36, combine with the flattened shape of the guide interior 13 are important factors in properly aligning the piston/chisel member 20 so that it can perform its lock-disrupting function. When the piston/chisel member 20 is in its fired overdrive position, a fraction of the chisel stem 34 remains inside of the guide interior 13 thereby preventing the piston/chisel member 20 from becoming rotationally misaligned after the tool has been fired. This assures that the tool can be quickly reset and used on other locked doors that may be encountered. Reset of the piston/chisel member 20 is accomplished by pushing the member 20 back to its retired position shown in FIG. 1 with a tool similar to a screw driver or the like.

The tool is operated in the following manner. The tool 2, as shown in FIG. 1, is in its ready-to-fire condition. When the tool 2 is pressed against a door jamb, or a lock, either in the door or door knob, the barrel 10 moves breechwardly to compress the spring 68 and move the firing chamber to a firing position wherein a chambered cartridge can be fired by pulling the trigger 64. When the cartridge is fired, the piston/chisel member 20 will be propelled muzzlewardly, and the chisel point 38 will clear the guide 14 about when the piston head 22 clears the vents 74. Thus, substantially the only recoil encountered by the user of the tool will be the resistance of the lock or door jamb to the chisel blade 36, which is not a significant factor. Tool recoil is thus minimal. As the chisel penetrates the door jamb, or encounters the door knob or lock cylinder, the piston/-chisel mass, and the velocity thereof, provide sufficient energy to dislodge or break any lock components which the chisel point 38 hits.

Figure 7:
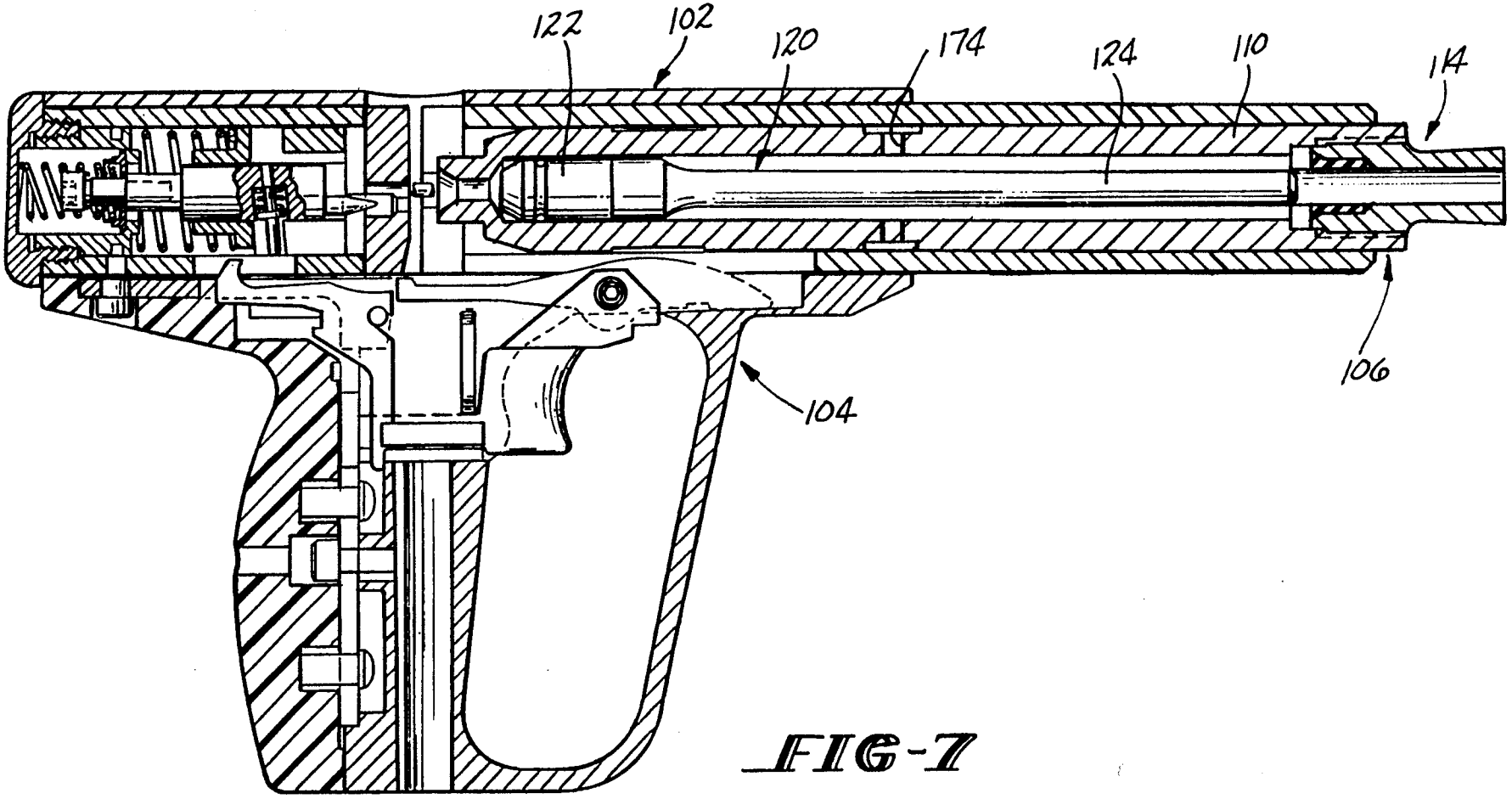
FIG. 7 is a view similar to FIG. 1 of a second embodiment of a tool formed in accordance with this invention.

Referring now to FIG. 7, a second embodiment of the tool of this invention is shown, which is particularly suited for disabling lock cylinders, either in doors or in door knobs. The tool of FIG. 7 is shown in its ready-to-fire condition. The tool 102 comprises a pistol grip module 104, and a piston/barrel module 106.

Like the first above-described embodiment, the piston/barrel module 106 includes a cylindrical barrel member 110, a piston 120 disposed within the barrel 110, and a muzzle bushing member 114 which is secured to the muzzleward end 106 of the barrel 110. The barrel 110 is mounted slideably within the muzzleward end of the pistol grip module 104. The piston 120 has a cylindrical piston head portion 122 and a cylindrical piston stem portion 124. It will be noted that the tool of FIG. 7 is very similar to a conventional fastener driving tool, except that the piston/barrel module 106 is longer than the barrel of a conventional fastener driving tool, and the piston 120 is also longer and heavier than the piston of a conventional fastener driving tool. Finally, the muzzle bushing 114 is sufficiently shorter than a muzzle bushing on a fastener driving tool to ensure that the piston 120 will be fired to an overdrive position wherein the piston stem 124 extends well beyond the muzzleward end of the muzzle bushing 114 each time the tool 102 is fired, as will be set forth hereinafter in greater detail.

Figure 8:
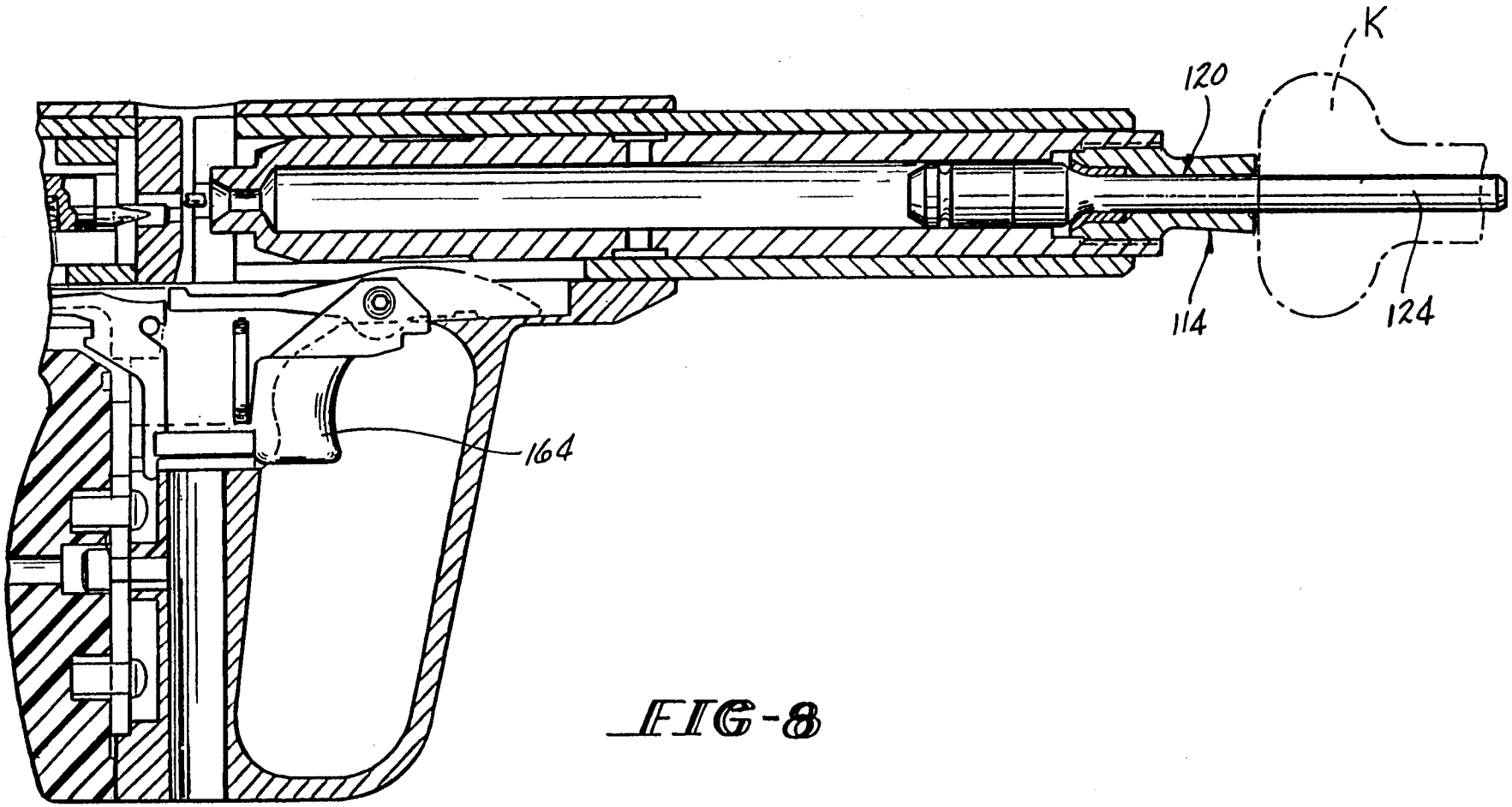
FIG. 8 is a view similar to FIG. 7 showing the piston in its driven position.

In FIG. 8 the piston 120 is shown in the overdrive position wherein the piston stem 124 has been driven muzzlewardly beyond the end of the muzzle bushing 114 to the extent necessary to penetrate the lock cylinder found in the center of a door-lock door knob K. The tool is used by simply being pressed against the door knob K, with the muzzle bushing 114 being aligned with the door knob lock cylinder to set the tool for firing, and the tool is then fired by pulling the trigger 164. The piston stem 124 will enter the lock cylinder portion of the door knob K and push the lock cylinder out of the opposite end of the door knob. The lock will thus be disabled and the door can be opened. This embodiment of the tool can also be used against locks which have their cylinders positioned in the door proper. In the latter case, the piston stem 124 will easily penetrate the door and knock the lock cylinder out of the opposite side of the door.

Since many changes and variations of the disclosed embodiments of the invention may be made without departing from the inventive concept, it is not intended to limit the invention other wise than is required by the appended claims.

What is claimed is:

1. A powder actuated tool for use in forcing door lock assemblies to allow easy access to buildings, said tool comprising:

a) a barrel assembly including a barrel bore for receiving and captively holding a piston therein, said barrel assembly having a breechward end adapted for admitting combustion gases into said barrel bore, said barrel assembly also including a muzzleward end for pressing against a door whose lock is to be forced; and b) a piston mounted in said barrel bore for reciprocal sliding movement in said barrel bore between a breechward firing position and a muzzleward fired position, said piston having a breechward piston head and a muzzleward piston stem, said stem having a muzzleward door-engaging surface, and said piston being sized relative to said barrel assembly to ensure that said door-engaging surface thereon extends beyond said muzzleward end of said barrel assembly at least about 2.5 inches when said piston is in said muzzleward fired position, so that said piston will be operative to disrupt or disable a door lock assembly at which it is fired.

2. The tool of claim 1 wherein said muzzleward end of said barrel assembly comprises a flattened oval cross-sectionally configured muzzle bushing, and said muzzleward door-engaging surface of said piston stem has a laterally flattened configuration complementary to said muzzle bushing, and which door-engaging surface remains in said muzzle bushing when said piston is in said firing position.

3. The tool of claim 2 further comprising means connecting said muzzle bushing to said barrel assembly and operable to ensure proper orientation of said muzzle bushing relative to the remainder of the tool and to the door lock assembly against which the muzzle bushing is pressed.

4. The tool of claim 3 further comprising means for preventing rotational movement of said piston relative to said barrel assembly when said piston is in said fired position.

5. The tool of claim 1 wherein said door-engaging surface on said piston stem is cylindrical and substantially the same size as a lock cylinder.

6. The tool of claim 1, further comprising a pistol grip module, said barrel assembly being telescopingly mounted in said pistol grip module, and a detent means mounted on said pistol grip module for releasably connecting said barrel assembly and said pistol grip module whereby said barrel assembly is reciprocally slidably mounted in said pistol grip module for cocking of the tool, and whereby said barrel assembly can be easily disconnected from said pistol grip module and replaced with a different barrel assembly.

7. A powder actuated tool for use in forcing door lock assemblies to allow easy access to buildings, said tool comprising:

a) a barrel assembly including a barrel bore for receiving and captively holding a piston therein, said barrel assembly having a breechward end adapted for admitting combustion gases into said barrel bore, said barrel assembly also including a muzzle bushing for pressing against a door whose lock is to be forced, said muzzle bushing having a flattened oval cross-sectional configuration; and b) a piston mounted in said barrel bore for reciprocal sliding movement in said barrel bore between a breechward firing position and a muzzleward fired position, said piston having a breechward piston head and a muzzleward piston stem, said piston having a muzzleward door-engaging portion which is transversely flattened to conform generally to the configuration of said muzzle bushing, said door-engaging portion being disposed in said muzzle bushing when said piston is in said firing position, and, when in said fired position, said door-engaging portion of said piston extending beyond a muzzleward end of said muzzle bushing sufficiently to disrupt or disable a door lock assembly at which it is fired.

8. The tool of claim 7 further comprising cooperating means on said barrel assembly and said piston for preventing rotation of said piston relative to said barrel assembly when said piston is in said fired position.

9. The tool of claim 7 wherein said means connecting said barrel assembly to said pistol grip module includes an external slot on said barrel assembly and a spring-biased detent mounted on said pistol grip module and extending into said barrel assembly slot.

10. A method for forcing a building door lock assembly which is housed at least partly in a door or door frame, to allow easy access to a building through said door, said method comprising the steps of:

a) providing a powder actuated tool having a captive piston contained in a barrel assembly, said barrel assembly having a muzzleward end, and said piston including a muzzleward door lock assembly-engaging surface;

b) pressing said muzzleward end of said barrel assembly against the door, door frame, or against a portion of the door lock assembly; and c) firing the tool to propel said muzzleward surface of said piston against a portion of the door lock assembly to disable the lock assembly from continuing to secure the door in a closed and locked condition.

* * * * *